United States Patent [19]

Suzuki

[11] 4,233,776

[45] Nov. 18, 1980

[54] ARTIFICIAL EYE STRUCTURE FOR USE IN A DOLL

[75] Inventor: Kenichi Suzuki, Koshigaya, Japan

[73] Assignee: Suzusei Co., Ltd., Saitama, Japan

[21] Appl. No.: 913,036

[22] Filed: Jun. 6, 1978

[30] Foreign Application Priority Data

Mar. 3, 1978 [JP] Japan ..... 53-23636

[51] Int. Cl.[3] ..... A63H 3/38

[52] U.S. Cl. ..... 46/165

[58] Field of Search ..... 46/1 F, 165, 166, 167, 46/168, 169, 170; 3/13; 428/33

[56] References Cited

U.S. PATENT DOCUMENTS

| | | | |
|---|---|---|---|
| 2,601,107 | 6/1952 | Ellett | 46/165 |
| 2,699,621 | 1/1955 | Levinson | 46/165 |
| 2,763,031 | 9/1956 | Rekettye | 46/165 |
| 2,991,588 | 7/1961 | Williams | 46/165 |
| 3,571,968 | 3/1971 | Samo | 46/165 |
| 3,801,414 | 4/1974 | Chin | 428/33 |
| 3,871,128 | 3/1975 | Grooms | 46/165 |
| 3,881,272 | 5/1975 | Parker | 46/165 |
| 3,952,445 | 4/1976 | Liebert | 46/165 |

*Primary Examiner*—Robert Peshock
*Assistant Examiner*—Michael J. Foycik, Jr.
*Attorney, Agent, or Firm*—L. Lawton Rogers, III

[57] ABSTRACT

An artificial eye structure in which the diameter of the dish shaped backing member is larger than the diameter of the eye so that face material is squeezed between the eye and the backing member to produce an unusual recessed effect.

7 Claims, 9 Drawing Figures

ARTIFICIAL EYE STRUCTURE FOR USE IN A DOLL

BACKGROUND OF THE INVENTION

1. Field of the Application

The present invention generally relates to an artificial eye structure for use in a doll, and more particularly to the improvement of an artificial eye structure that can be placed in a recessed state on the surface of a piece of cloth used for a face portion of a doll with a marked effect of reality or lifelike expression of the eyes in a doll face. This particular effect of recessed appearance of the doll's eye structure can only be attained by the advantageous construction of the present invention wherein there is provided an improvement specifically designed for bringing such recessed appearance of the doll's eye structure when assembled in the doll face.

Introduction of the Prior Art

One of typical prior art constructions of the eye structure for use in a doll is such that the eye structure comprises an eye piece having a rod stemmed extending outwardly in the backside thereof and adapted to insert through an opening formed in a face material cloth, and a counter member to securely engage with the leading end of the projecting rod of the eye piece through the face cloth.

In such typical conventional constructions of the eye structure for use in a doll, it is a general practice that the diameter of the eye piece is generally equal to that of the counter member to be located inside the cloth and engaged therewith. Due to such construction, it is inevitable that when the eye structure in the doll face is repeatedly forced or urged inward from the surface thereof, as is often done by children as they play with their dolls, the face material cloth could be worn and torn in the area around the eye structure, and finally the doll eye could come off and lost.

On the other hand, the extent or depth of the recessed appearance of the eye structure in the doll face essentially depends upon the thickness or extent of elasticity of the cloth material selected for the formation of the doll's face, or in other words, the effect of recessed looking of an eye structure in a doll's face can merely be expected from an accidental extent of sinking of the eye structure into the material cloth due to the clamping effect rendered when the eye piece and the counter member are firmly assembled together. Therefore, such effect of generally recessed appearance or lifelike effect of the doll eyes is only a probable factor expected from the face material cloth selected.

In this respect, it will be useful in the manufacture of the dolls if there is attained an improvement which would originally bring the effect of such recessed looking of the doll's eyes, as well as the prevention of frequent tear or wear of the face material cloth around the doll's eyes. The present invention is essentially intended to meet such requirements.

SUMMARY OF THE INVENTION

In respect of the disadvantages of the prior art eye structure of a doll mentioned above, the present invention is to provide an improvement, wherein the diameter of the counter engagement member is made greater than that of the eye piece, and wherein the counter engagement member is designed with a generally U-letter cross-sectional shape. With these advantageous features, the present invention can attained useful effects such as the possibility of reducing the wear of the face material cloth around the circumference of the eye. Furthermore, the doll can be given a lifelike expression in the eye with the positively recesses appearance thereof.

Therefore, it is the primary object of the present invention to provide an improvement of the eye structure for use in a doll which provides a positive effect of preventing possible wear of the face material cloth around the periphery of the eye structure.

It is anothwer object of the present invention to provide an improvement wherein each of members constituting the eye structure may be successively and integrally injection-molded using a thermal plastic resin having desired colors so as to form the entire eye structure of the doll.

According to the present invention, briefly summarized by way of a preferred embodiment thereof in the first aspect thereof, there is provided an improvement of the eye structure for use in a doll wherein there are provided an eye piece having a rod stemmed extending from the backside thereof, and a counter engagement member having a greater diameter than that of the eye piece and having a generally U-letter shaped cross-sectional shape, and adapted to firmly receive the projecting rod of the eye piece extending through an opening formed in a face material cloth in such a manner that the face material cloth is pushed or raised outwardly from inside around the periphery of the eye structure so as to form a generally recessed looking therearound.

Furthermore, according to the present invention in the second aspect thereof, there is provided an improvement wherein a projecting rod is firstly formed in a thin and elongated bar shape from a black-colored opaque thermal plastic resin, the pupil portion being then integrally injection-molded to a semi-spherical shape using the same material as of the projecting rod at one end thereof with a spherically convex surface thereof facing outwardly, the iris portion being injection-molded in a planar shape of a substantially greater diameter than that of the pupil portion and immediately abutted against the flat back surface of the pupil portion of a semi-spherical shape using an opaque thermal plastic resin of a desired color, finally the outermost transparent portion being further injection-molded on and around the pupil and iris portions in a generally semi-spherical shape so as to wholly envelope them as a unit in a laminar fashion, thus forming the entire eye ball construction of the doll.

The above-mentioned objects and advantageous features of the present invention, as well as further objects and advantages thereof, may become apparent from the following detailed description of the present invention, by way of a preferred embodiment thereof, when read in conjunction with the accompanying drawing in which like parts are designated with like reference numerals.

DETAILED DESCRIPTION OF THE PREFERRED EMBODIMENT

A description will now be made in detail with respect to preferred embodiments of the present invention in conjunction with the accompanying drawing.

Figure 1:
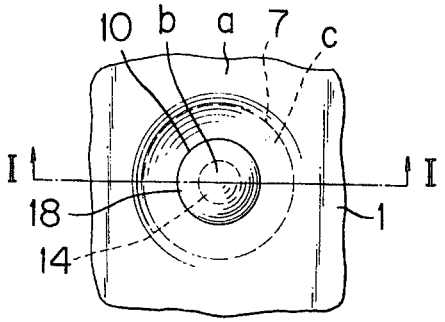
FIG. 1 is a top plan view showing a preferred embodiment of the present invention.
Figure 2:
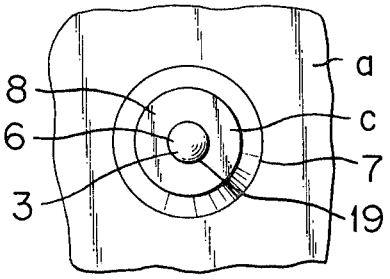
FIG. 2 is a bottom view showing the backside of the embodiment shown in FIG. 1.
Figure 3:
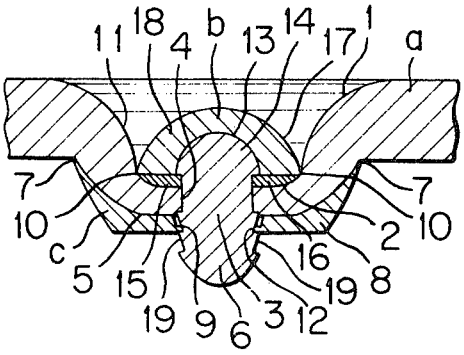
FIG. 3 is a vertical cross-sectional view taken along the plane designated with the line I—I in FIG. 1.
Figure 4:
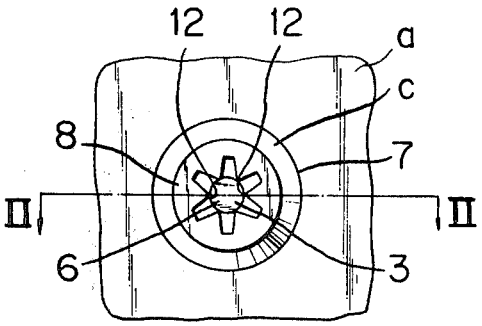
FIG. 4 is a bottom view similar to FIG. 2 showing another embodiment of the present invention.

Firstly, referring to FIGS. 1 through 3, there is shown an eye structure for use in a doll according to the first aspect of the present invention, by way of the first embodiment thereof, wherein there are provided a surface or right side 1 of a material fabric or cloth (a) for a doll face having an opening 4 therethrough, an eye piece member (b) of a generally semi-spherical cross-sectional shape having a projecting rod 3 stemmed from the backside thereof and adapted to pass with its leading end 6 through the opening 4 in the face cloth (a) toward the opposite side 5 thereof, and a receiving or engagement member (c). The engagement member (c) comprises a bottom piece 8 having a generally U-letter cross-sectional shape, a circumferential edge portion 7 at the extremity of a concave surface having a greater diameter than the outer diameter of the eye piece member (b) and a central opening 9 adapted to firmly receive the leading end 6 of the projecting rod 3. When the eye structure is assembled by having the projecting rod 3 of the eye piece member (b) firmly engaged with the engagement member (c) through the opening 4 of the face cloth (a), the face cloth (a) is forced outwardly from inside by a staggered engagement between the circumferential edge portion 7 of the eye piece member (b) and the engagement member (c) so as to form a generally recessed area 11 around the pherphery 10 of the eye piece member (b) when looked in front of the doll's face. In order to obtain a positive engagement effect between the eye piece member (b) and the bottom piece 8, there is provided a flexible flanged portion 12 in the inner circumference of the central opening 9 of the bottom piece 8, and the projecting rod 3 of the eye piece member (b) is provided with a plurality of shoulders or steps 19 so that when assembled, they may positively snugly engage with each other, thus providing a firm fixation therebetween.

Now, according to a second aspect of the present invention, there are as typically shown in FIG. 3 an eye piece member (b) formed form black-colored thermal plastic resin comprising a pupil portion 14 of a generally semi-spherical shape having a spherical or curved outer surface 13 and a projection rod 3 having an elongated shape and stemmed from a flat bottom surface 15 of the pupil portion 14, both of which are formed integrally by the injection-molding process, against which there is formed a flat and round iris portion 16 of a desired color, such as blue, green, brown or white, from a thermal plastic resin by the injection-molding process to a greater outer diameter than that of the pupil portion 14 in a laminar fashion, thereafter totally enveloping the pupil and iris portions 14 and 16 with a transparent thermal plastic resin coating layer 18 forming a greater-diametered semi-spherical outer surface 17 by using the laminating injection-molding process so as to form an entire eye ball structure of the doll.

Figure 5:
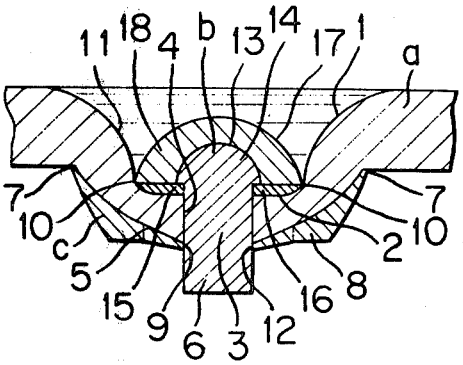
FIG. 5 is a vertical cross-sectional view taken along the plane designated with the line II—II in FIG. 4.
Figure 6:
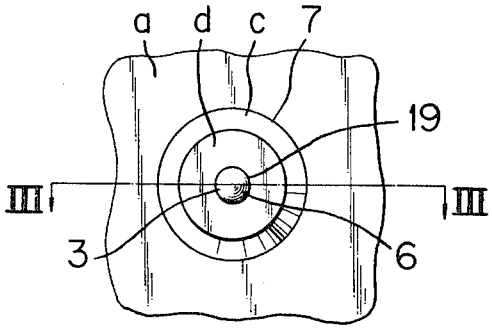
FIG. 6 is a bottom view showing a third embodiment of the invention.

As an aid for providing an engaging effect between the projecting rod 3 of the eye piece member (b) and the engagement member (c), instead of the arrangement as shown in FIG. 3, it is also possible to have such as effect of positive engagement therebetween by providing a plurality of star-shaped lips or teeth in the flexible flanged portion 12 so as to permit a forcible insertion of the eye piece member (b) into the central opening 9 of the engagement member (c), but positively preventing the rod 3 from getting loose, as shown in FIG. 5, by way of a second embodimwent of the invention.

Figure 7:
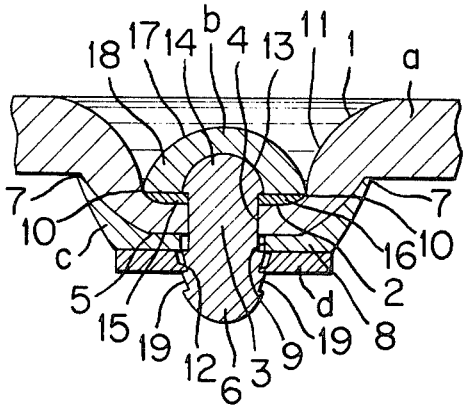
FIG. 7 is a vertical cross-sectional view taken along the plane designated with the line III—III in FIG. 6.
Figure 8:
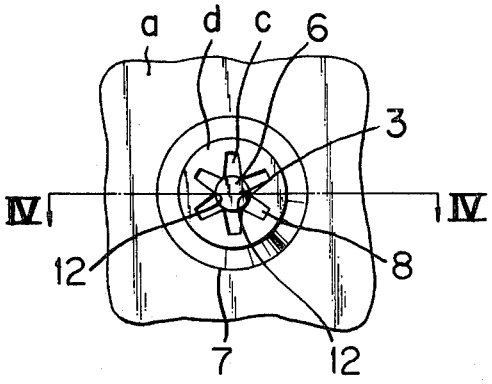
FIG. 8 is a bottom view showing a fourth embodiment of the present invention.

As a further embodiment of the invention, it is obviously practicable to provide the flexible flanged portion 12 in the inner circumference of an independent lock washer (d), thereby to positively engage with the steps 19 formed in the projecting rod 3 of the eye piece member (b) as typically shown in FIG. 7.

Figure 9:
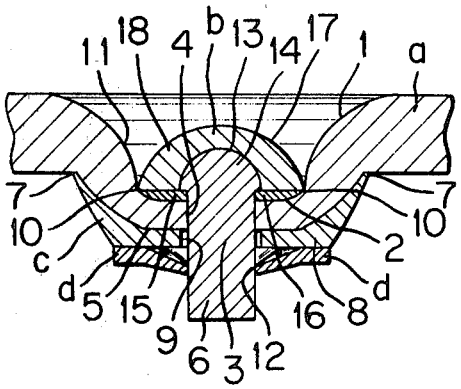
FIG. 9 is a vertical cross-sectional view taken along the plane designated with the line IV—IV in FIG. 8.

As a fourth embodiment of the invention, it is also possible to provide an independent lock washer (d) having a plurality of starlike flexible lips or teeth in the inner circumference thereof, which lock washer is disposed immediately adjacent the engagement member (c) so as to positively prevent the projecting rod 3 from getting loose, as typically shown in FIG. 9.

In operation, according to the first aspect of the present invention, when assembling the eye piece member (b) with the engagement member (c), the projecting rod 3 of the eye piece member (b) is threaded manually with its leading end 6 through the opening 4 formed in the face material cloth (a), with the flat bottom surface 2 of the member (b) abutted against the right side 1 of the cloth (a), into the central opening 9 of the bottom piece 8 of the engagement member (c) having the generally U-letter cross-sectional shape of a greater diameter than the outer diameter of the eye piece member (b) forcibly against the contracting force produced by the flexible flanged portion 12 formed in the central opening 9 of the bottom piece 8 so that one of the steps 19 of the projecting rod 3 may firmly engage with the flanged portion 12. Once the eye piece member (b) is forcibly inserted into the engagement member (c), the former is assuredly held in a positively engaged state, however far it is manually pressed forwardly in the assembling procedure, while the outer area of the face cloth (a) is urged or raised substantially outwardly by the circumferential edge portion 7 of the engagement member (c) around the circumferential area of the eye piece member (b) according to the extent of manual pressing effect of the eye piece member (b), consequently resulting in a desired extent of recessed appearance or lifelike expression of the doll eyes on the surface of the face material cloth (a). This advantageous construction can also provide, a fully stated hereinbefore, the effective prevention of occasional fatigue of the face material cloth around the circumference of the eye piece member.

According to other embodiments of the present invention as typically shown in FIGS. 5, 7 and 9, respectively, there is likewise produced similar effect of engagement between the leading end 6 of the projecting rod 3 of the eye piece member (b) and the engagement member (c) or th extra lock washer (d).

Also, it is apparent in an attempt to provide the similar effect of positive engagement between the eye piece member (b) and the engagement member (c) that a plurality of shoulders or steps may be formed in the outer circumference of the projecting rod 3 of the eye piece member (b) instead of the inner circumference of the central opening 9 of the engagement member (c), and that a flexible flanged portion may also be provided projecting in the outer circumference of the projecting rod 3 of the eye piece member (b), respectively.

According to the second aspect of the invention, there is provided an efficient process of injection molding to allow the successive formation of an improved eye structure for use in a doll wherein the projecting rod 3 of the eye piece member (b) is firstly formed in a thin and elongated bar form from the black-colored opaque thermal plastic resin, the pupil portion 14 being then integrally injection-molded to the semi-spherical shape using the same material as of the projecting rod 3 at one end thereof with the spherically convex surface 13 thereof facing outwardly, the iris portion 16 being injection-molded in a planar shape of a substantially greater diameter than that of the pupil portion 14 and immediately abutted against the flat back surface 15 of the pupil portion 14 using the opaque thermal plastic resin of the desired color, finally the outermost transparent portion 18 being further injection-molded on and around the pupil and iris portions in a generally semi-spherical shape forming the relative greater spherical outer surface 17 so as to wholly envelope them as a unit in a laminar fashion, thus forming the entire eye ball structure of a doll with a substantially marked efficiency of manufacture on an industrial scale.

Although fully described herein on the preferred embodiments of the present invention, there may be many variations and modifications derivable to those skilled in the art. For example, with respect to the means to effect the positive engagement between the projecting rod 3 of the eye piece member (b) and the engagement member (b), it is also practicable to provide serrations, threads, coarse surfaces, irregular undulations, or any other forms that may cause an effective frictional effect between the inner circumference of the central opening of the engagement member (b) and the outer circumference of the projecting rod 3 of the eye piece member (b) so as to prevent the eye piece member (b) from getting loose from the engagement member (c).

What is claimed is:

1. An artifical eye structure comprising:

an eye piece including:

an elongated stem, the front end of which is visible as the pupil of the eye, a washer carried by said stem, said washer having an outer diameter larger than the diameter of the stem whereby the front surface of said washer is visible as the iris of the eye, and a covering member for the front end of said stem and the front surface of said washer, said pupil and said iris being visible through said covering member; and retaining means for receiving and retaining the back end of said stem whereby said retaining means can be located behind a face material and said washer in front thereof to retain the eye in the face material.

2. The artificial eye structure of claim 1 wherein said retaining means is concave toward said eye piece; and wherein said eye piece is generally semi-spherical with a portion of said elongated stem extending rearwardly therefrom, the diameter of said eye piece being small relative to the diameter of the concavity of said backing member.

3. The artificial eye structure of claim 2 wherein said retaining means is configured so that assembly of said eye piece to said retaining means with face material therebetween and with the front of the eye piece to the rear of the plane of the forward circumference of the retaining means squeezes the face material to provide a recessed artificial eye.

4. The artificial eye structure of claim 2 including means for selectively varying the depth of said eye piece relative to the concavity of said retaining means.

5. The artificial eye piece of claim 1 wherein the front end of said elongated stem includes a rearward facing shoulder; and wherein said washer is flat and abuts said rearward facing shoulder.

6. A method of forming an eye piece for use in an artificial eye structure comprising the steps of:

(a) forming an elongated rod, (b) forming a semi-spherical shape on the front end thereof to serve as the pupil, the pupil having a rearward facing shoulder;

(c) forming a washer having an outer diameter larger than the diameter of the pupil and an inner diameter mating with the diameter of the rod, the forward facing surface of the washer serving as the iris;

(d) positioning the washer on the rod against the rearward facing shoulder of the pupil; and (e) encasing the pupil and the iris in an eye shape through which the pupil and iris may be seen to thereby form an eye piece for an artificial eye.

7. A method of recessing an artificial eye in the face material of a doll or the like comprising the steps of:

(a) providing an elongated rod shaped at the front end thereof to serve as the pupil of the eye and having a rearward facing shoulder;

(b) providing a washer having an outer diameter larger than the diameter of the pupil and an inner diameter approximately the diameter of the rod;

(c) positioning the washer on the rod against the rearward facing shoulder of the rod so that the front of the washer serves as the iris of the eye;

(d) encasing the pupil and the iris in an eye shape through which the pupil and iris may be seen;

(e) providing a concave backing member with a central aperture adapte to retain the rear end of the rod when inserted therein;

(f) locating the backing member behind the face material; and (g) inserting the rod into the aperture in the backing member to a depth sufficient to recess the iris behind the plane of the periphery of the backing member and to locate the front of the eye shape behind the face material.

* * * * *